United States Patent [19]

Immega et al.

[11] Patent Number: 4,939,982

[45] Date of Patent: Jul. 10, 1990

[54] AXIALLY CONTRACTABLE ACTUATOR

[76] Inventors: Guy Immega, 4490 West 11th Avenue, Vancouver, British Columbia, Canada, V6R 2M3; Mirko Kukolj, 5490 Braelawn Drive, Burnaby, British Columbia, Canada, V6B 4R7

[21] Appl. No.: 788,001

[22] Filed: Oct. 16, 1985

Related U.S. Application Data

[63] Continuation-in-part of Ser. No. 600,978, Apr. 16, 1984, Pat. No. 4,733,600.

[30] Foreign Application Priority Data

Jun. 24, 1985 [JP] Japan ..... 60-136212

[51] Int. Cl.[5] ..... F15B 15/00

[52] U.S. Cl. ..... 92/92; 92/48; 92/90; 254/93 R

[58] Field of Search ..... 92/48, 90, 91, 92; 254/93 R

[56] References Cited

U.S. PATENT DOCUMENTS

| | | | |
|---|---|---|---|
| 2,019,160 | 10/1935 | Scusch | 92/91 X |
| 2,438,088 | 9/1949 | Haven | 92/92 X |
| 3,645,173 | 2/1972 | Yarlott | 92/92 |

FOREIGN PATENT DOCUMENTS

| | | | |
|---|---|---|---|
| 2100346 | 12/1982 | United Kingdom | 92/90 |

*Primary Examiner*—John Fox

*Attorney, Agent, or Firm*—Shlesinger & Myers

[57] ABSTRACT

An axially contractable actuator which includes an elongated hollow enclosure (14) formed by a fluid impermeable substantially non-elastic material and having a plurality of protrusions each with respective bases having more than three sides. Each base side (48) of a protrusion is attached to a base side (48) of an adjacent protrusion by a flexible seam of continuous fold (55). Each protrusion is foldable about a plane dividing the protrusion into two parts from an axially-extended condition in which the base sides are substantially parallel, to an axially-contracted condition in which the protrusion encloses a volume larger than that enclosed in the axially-extended condition. A pair of axially-aligned end terminations (18) are formed at each end of the enclosure with one of the end terminations being hollow. A pair of end connectors are each coupled to a respective end termination with one of the end connectors having an axial bore providing fluid communication between an interior of the hollow enclosure as a source of pressurized fluid.

15 Claims, 7 Drawing Sheets

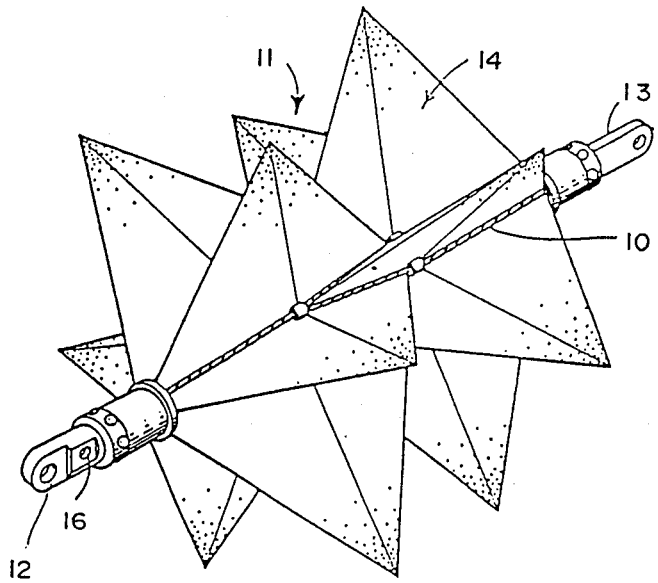

FIG. 15
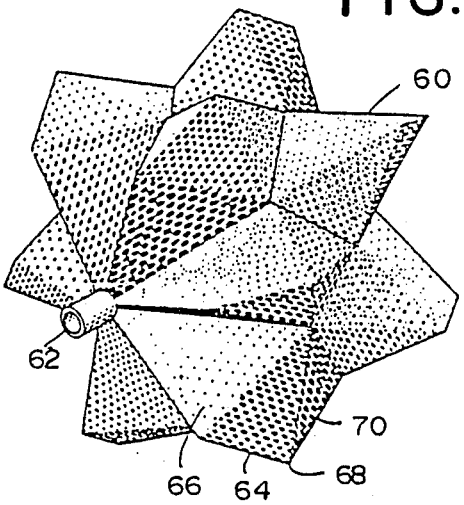
FIG. 17
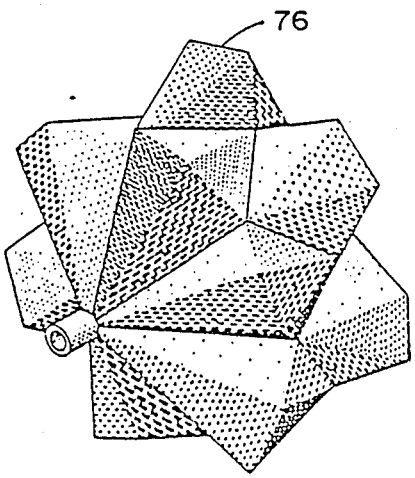
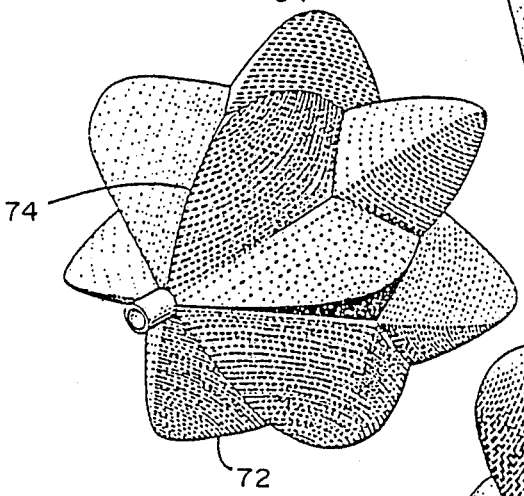
FIG. 16
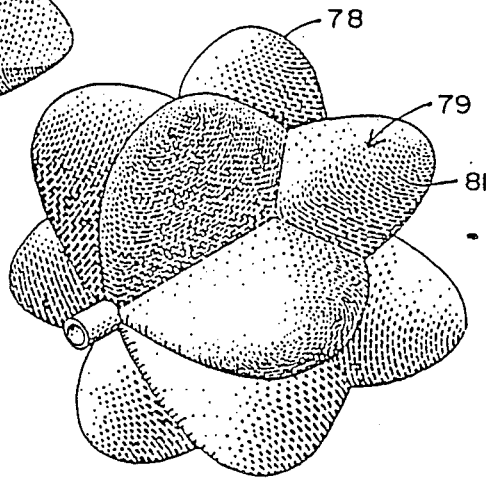
FIG. 18

AXIALLY CONTRACTABLE ACTUATOR

RELATED APPLICATIONS

This application is a continuation-in-part of the copending U.S. Pat. application Ser. No. #06/600,978 filed Apr. 16, 1984, now U.S. Pat. No. 4,733,600.

BACKGROUND

The present invention relates to an inflatable contractable tension actuator inflatable in response to increasing fluid pressure.

Earlier inflatable, contractable actuators designed for providing a selected tension force between two points include U.S. Pat. No. 2,483,088 issued Sept. 27th, 1949 to de Haven which is composed of an inner elastomeric tube and an outer tensioning tube composed of strands interwoven on the diagonal, forming a plurality of left-handed and right-handed helices in the shape of a continuous tube. Radially directed force on the helically wound strands is provided by the inner tube in response to increasing the fluid pressure therein. Expansion of the helices translates into overall contraction and resultant tension applied to the actuator end supports.

U.S. Pat. No. 2,844,126 issued July 22, 1958 to Gaylord discloses an elongated expansible bladder made of flexible elastomeric material surrounded by a woven sheath forming an expansible chamber which contracts in length when expanded circumferentially by pressurized fluid. The sheath and end connectors translate radial expansion to axial force on a load.

U.S. Pat. No. 3,645,173 issued Feb. 29th, 1972 to Yarlott discloses an elongated flexible thin-walled bladder coupled at either end to coupling member end supports. The bladder expands or contracts radially in response to increased or decreased fluid pressure in the bladder, respectively, translating to axial movement of the end supports from extended or retracted positions, respectively. A network of spaced apart longitudinally-extending inextensible strands coupled by spaced apart inextensible strands embedded in the bladder, prevent elastic expansion of the shell and assist in translating radial force into axial tension.

Russian Patent No. 291,396 issued in 1971, discloses a flexible bladder with non-stretchable threads fitted in the tube walls and affixed to end terminals similar to Yarlott.

An important source of failure of devices such as de Haven arises from rubbing of the inextensible strands on the bladder. Such friction is at a maximum at the start of any contraction or extension due to the static nature of the friction and the requirement to break through this relatively high level of static friction before experiencing a lower dynamic friction. In devices such as de Haven, elastic hysteresis occurs due to expansion of the bladder surrounded by the strands.

The second limitation of some foregoing devices arises because of the relatively limited amount of contraction as a percentage of the uncontracted distance between the actuator ends that such actuators can achieve. The percentage contraction of the de Haven and Gaylord actuators is limited by the need to change the angle of the woven strands in the outer sheath during contraction. The amount of pulling force and the percentage contraction of an axially contractable actuator is directly related to the volumetric expansion of the bladder since the work done by the actuator equals the pressure therein multiplied by the total change in volume inside the actuator. In the above devices, the volume change inside the bladder is set substantially by the volume change inside the inextensible strands or cables, sometimes referred to as the spindle volume.

Although Yarlott, de Haven and Gaylord refer to a requirement for only flexible material for the bladder, de Haven and Gaylord indicate elastomeric material as being preferable. It has been discovered that operation of devices such as de Haven and Gaylord is enhanced by the lateral forces exerted on the strands as a result of elastic expansion of the bladder between the strands. Unfortunately, the high friction forces on, and tension forces in the fabric at these locations drastically increases the likelihood of actuator failure.

SUMMARY OF THE INVENTION

According to the invention, there is provided an axially contractable actuator which includes an elongated hollow enclosure formed by a fluid impermeable substantially non-elastic membrane. The enclosure has a plurality of [convex polyhedra] protrusions each with respective bases having more than three sides. Each base side of a protrusion is attached to a base side of an adjacent protrusion by a flexible seam or continuous fold, and each protrusion foldable about a plane dividing the protrusion into two parts from an axially-extended condition in which the base sides are substantially parallel to an axially-contracted condition in which the protrusion encloses a volume larger than that enclosed in the axially-extended condition. A pair of axially-aligned end terminations is formed at each end of the enclosure with one of the end terminations being hollow. A pair of end connectors are each coupled to respective end terminations with one of the end connectors having an axial bore which provides fluid communication between an interior of the hollow enclosure and a source of pressurized fluid. A provision of a plurality of protrusions articulating about their base seams and sides allows the use of substantially non-elastic material for the membrane of the hollow enclosure or bladder, thereby avoiding failure problems associated with elastomeric material. Moreover, the hollow enclosure may be made from flat sheet material which is strong enough to withstand standard pneumatic line pressures. Alternatively, the hollow enclosure may be a single-curved hollow membrane. Moreover, the output force exerted and work done by such an actuator is relatively large due to the large change in volume and a large percentage contraction achievable by the enclosure. The percentage contraction is large due to the ability of the enclosures to articulate without excessive radial bulging. Furthermore, if the hollow enclosure is made from flat sheet material, the volume enclosed by the actuator in the axially-extended state becomes significantly minimized, thus increasing actuator efficiency.

The actuator may include a network of linked cables attached to the end connectors and extend over the base seams of the protrusions to enclose the hollow enclosure for transmitting tension force in the membrane of the enclosure to pulling force at the end connectors. By utilizing substantially non-elastic material for the membrane of the hollow enclosure, the hollow enclosure and linked cables move together with no sliding friction between the two. The network of linked cables transmits tension force in the membrane of the enclosure to pulling force at the ends of the actuator; thus, there is no breakaway force resulting from static friction to be overcome between the enclosure and the linked cables. Another advantage of the linked cables is that the length of the links of the cable can be selected in order to modify the characteristic force curve of the actuator. For smaller actuators or actuators operating at lower pressure, the network of linked cables is optional, as the tensile strength of the hollow enclosure can be made sufficient to transmit the pulling forces to the ends of the actuator.

By utilizing properly dimensioned articulating protrusions such as convex four-sided pyramids, increased reliability is obtained due to the minimization of stretching or buckling in the enclosure membrane. Proper dimensioning of the protrusions also allows modification of the characteristic force curve of the actuator.

Advantageously, the membrane of the hollow structure is made of a flexible material. Utilizing a flexible material rather than a rigid plate for the protrusions results in a more even distribution of membrane tension forces over the length of the base seams of the protrusions.

The end connectors may have a plurality of longitudinally-extending spaced apart cable stanchions for receiving cable loops from ends of the linked cables which pass between the stanchions and loop around ends thereof. A nipple protruding from an end of one of the connectors is used for snug reception of a corresponding end termination of the hollow enclosure and a retainer ring is provided for engagement over the stanchions so as to lock the cable loops in place around the stanchions and hold the cables close to the hollow enclosure.

One of the nipples may have a hollow interior and be in fluid communication with a fluid orifice in the connector for coupling to a source of pressurized fluid.

The linked cables may each be terminated with a fitting and the end connectors may have corresponding sockets radially spaced apart for reception of respective fittings A retainer ring is engaged over the ends of the cables and end connectors for retention of the cables to the end connectors.

The protrusions may be in the shape of convex polyhedra. The polyhedra may each be truncated transversely to the base thereof when the associated polyhedra are folded substantially flat. Alternatively, they may be truncated substantially parallel to the base when folded substantially flat.

The protrusions may have an arcuate outer periphery extending from one end thereof to an opposite thereof.

Alternatively, the convex polyhedra may be formed into dome shapes.

BRIEF DESCRIPTION OF THE DRAWINGS

FIG. 15 is a perspective view of an actuator having protrusions in the shape of four-sided convex polyhedra having an outer surface which is truncated substantially parallel to the base of the polyhedra when the latter is folded flat.

FIG. 16 is a perspective view of an actuator having polyhedra with arcuate outer peripheries.

FIG. 17 is a perspective view of an actuator the protrusions of which are in the form of convex polyhedra truncated transverse to the base thereof when the latter are folded substantially flat.

FIG. 18 is a perspective view of an actuator having substantially dome-shaped protrusions.

DETAILED DESCRIPTION WITH REFERENCE TO THE DRAWINGS

Figure 1:
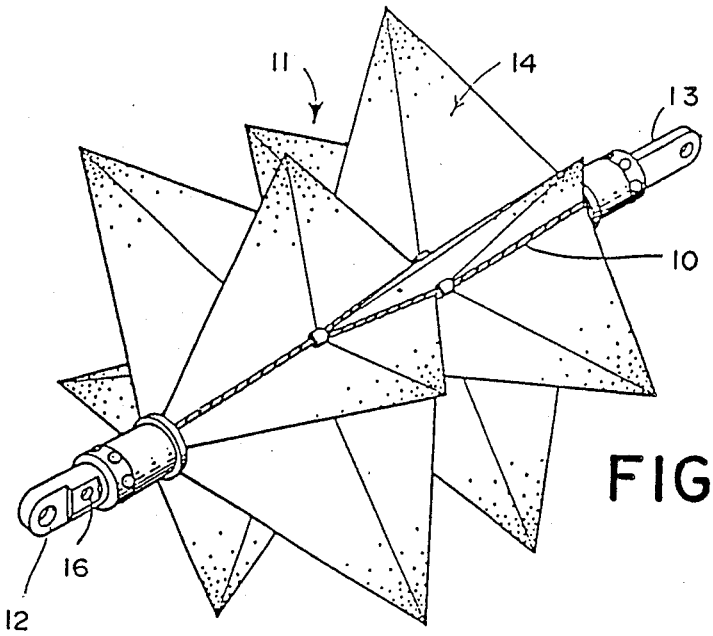
FIG. 1 is a perspective view of an actuator according to a preferred embodiment of the invention in an axially-extended state.

The actuator 11 shown in FIG. 1 in axially-extended form has a network of linked cables 10 which are attached to end connectors 12 and 13. The axial direction extends between connectors 12 and 13. The network of linked cables 10 surrounds a hollow enclosure 14 made of flexible, substantially non-elastic, impermeable material which is also attached to end connectors 12 and 13. The hollow enclosure 14 which protrudes through apertures of the network of linked cables 10 can accommodate fluid pressure from a gaseous or liquid medium.

Figure 2:
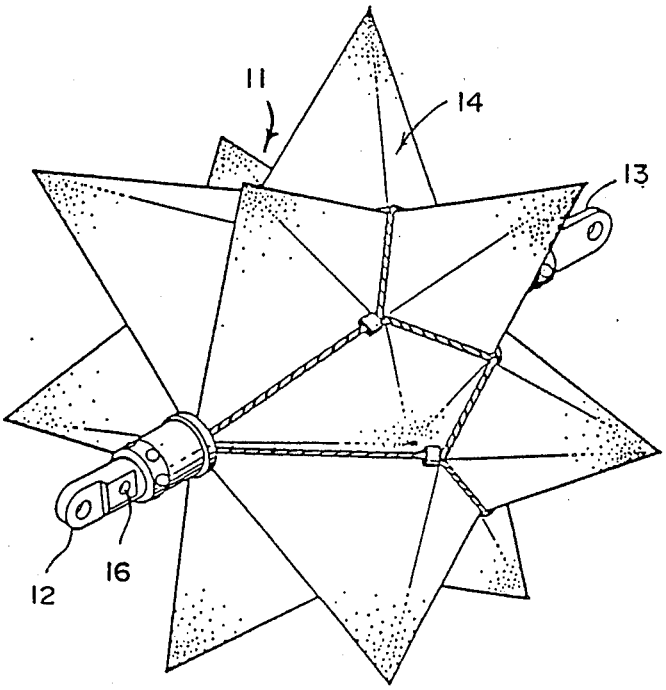
FIG. 2 is a perspective view of the actuator of FIG. 1 in a partially axially-contracted state.

The actuator 11 in axially-contracted form is shown in FIG. 2.

Figure 3:
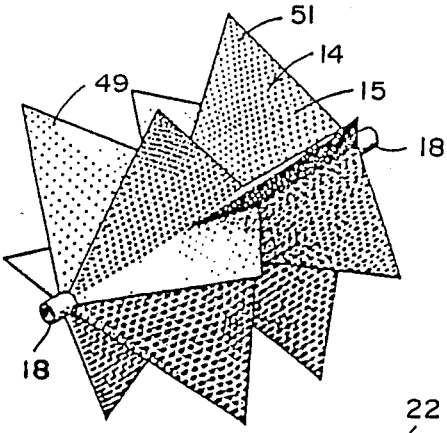
FIG. 3 is a perspective view of the hollow enclosure shown in FIG. 1 in a axially-extended state.
Figure 5:
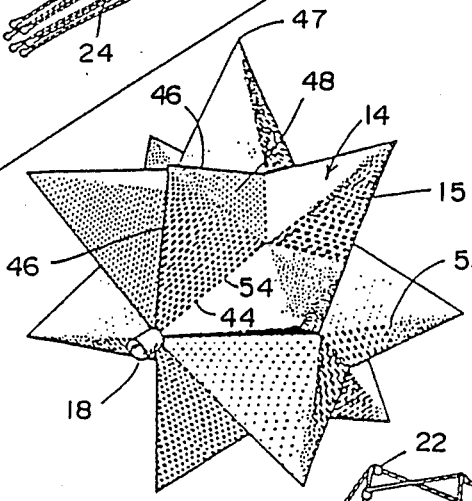
FIG. 5 is a perspective view of the hollow enclosure shown in FIG. 1 in an axially-contracted state.
Figure 7:
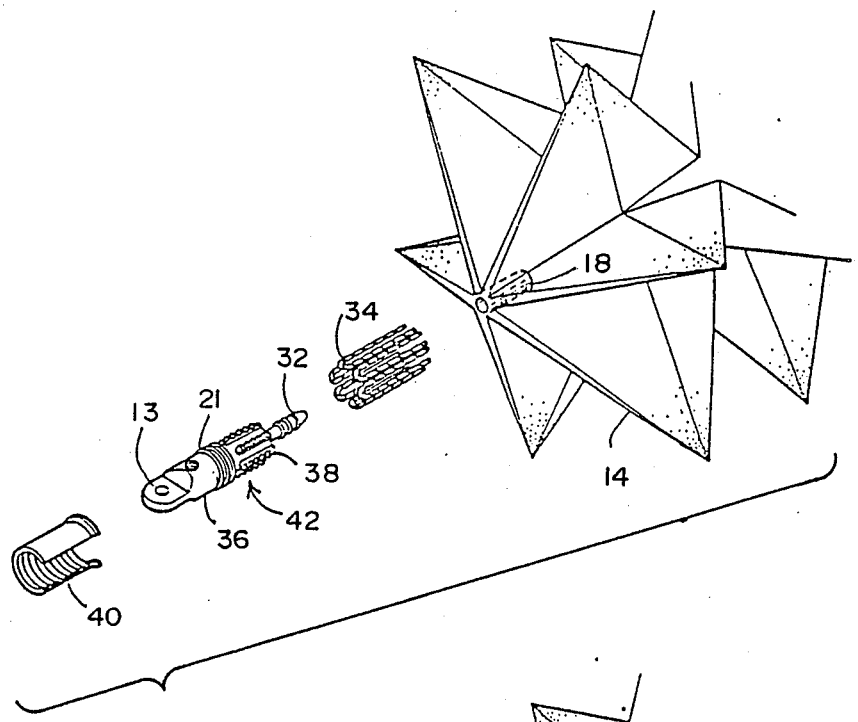
FIG. 7 is an alternative end connector assembly and an inverted nipple extending inside the hollow enclosure.

The hollow enclosure 14, illustrated in FIGS. 3 and 5 without the network of linked cables 10 and end connectors 12, is made from flexible, substantially non-elastic impermeable material, such as for example woven fibres of nylon or kevlar TM bonded with flexible rubber or plastic to form an impermeable membrane. In FIG. 3, the hollow enclosure is in the axially-extended state, while FIG. 5 shows it in the axially-contracted state. A tubular nipple 32 and fittings 18 may either be external to the hollow enclosure 14 or internal thereto as shown in FIG. 7. The hollow enclosure 14 has a characteristic shape of multiple interconnected convex polyhedra which are in this embodiment approximate four-sided pyramids 15 joined along their basal edges 44, each pyramid having lateral corners 46 extending from the basal edge intersections to an apex 47. The corners 46 are formed by the intersection of adjacent polyhedron faces 48. The hollow enclosure embodiment shown in FIG. 3 has two stages 49 and 51 along the actuator axis of six four-sided pyramids each, for a total of twelve pyramids in all. Other hollow enclosure configurations of more than two stages of convex polyhedra along the actuator axis and fewer than or greater than 6 convex polyhedra in each stage work well also.

Figure 4:
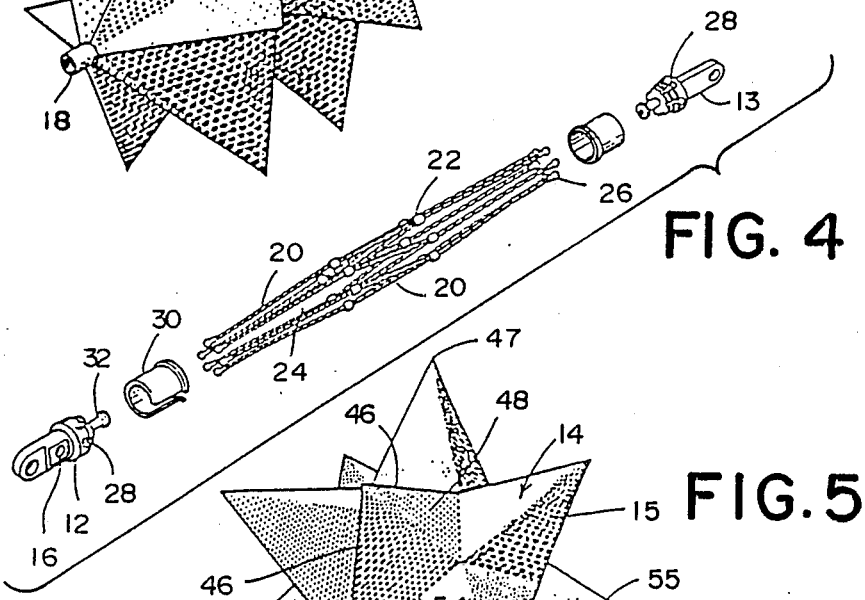
FIG. 4 is a perspective view of the network of linked cables with end connectors of the actuator of FIG. 1 in an axially-extended state.
Figure 6:
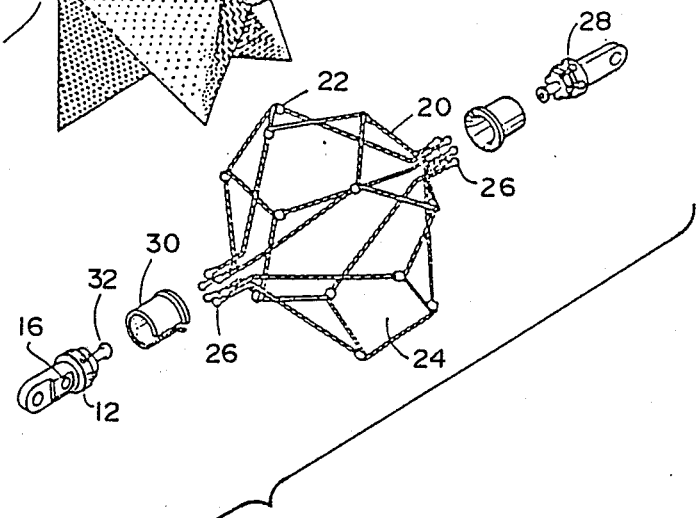
FIG. 6 is a perspective view of the network of linked cables of the actuator of FIG. 1 in an axially-contracted state.

FIGS. 4 and 6 illustrate the network of linked cables 10 and the end connectors 12 in isolation from the hollow enclosure 14. The network 10 is comprised of non-stretchable flexible tension links 20 which are joined together at nodes 22 so as to form four-sided diamond-shaped apertures 24 in the network. The cables or tension links 20 are terminated with bulbous fittings 26 which are inserted into sockets 28 in the end connectors 12 and 13 thus forming a strong connection. Retaining ring 30 serves to hold the bulbous cable terminations 26 into the sockets 28 of the end connectors 12 and to hold the cable elements 20 next to the hollow enclosure 14 as the actuator 11 contracts axially. End connectors 12 and 13 serve to transmit actuator cooling force to a load. End connector 12 also serves to let liquid or gas into or out of the hollow enclosure 14 by means of orifice 16 and the nipple 32 having a hollow interior which is in fluid communication with orifice 16.

Other network designs employing six-sided apertures, for example, are also possible. The network of linked cables 10 is fabricated from multiple-strand steel cables 20 joined together at the nodes 22 with metal compression ferrules. Other materials can be used for the network of linked cables 10, for example, solid wire, pivoted rigid links, joined twine, and synthetic fibres.

FIG. 7 illustrates an alternative end connector 42 suitable for tension actuators with a cable network 10 having looped ends 34 thereof attached to the end connector body 36. Threaded cable stanchions 38 serve to transmit the pulling force from the cable elements to the end connector body 36. The retainer ring 40 is internally threaded so that it can be screwed over the end connector body 36. An internal termination 18 to the hollow enclosure 14 is provided for receiving a nipple 32 of the end connector 42. An internal end termination of the hollow enclosure allows shortening of the total length of the actuator 11.

Figure 8:
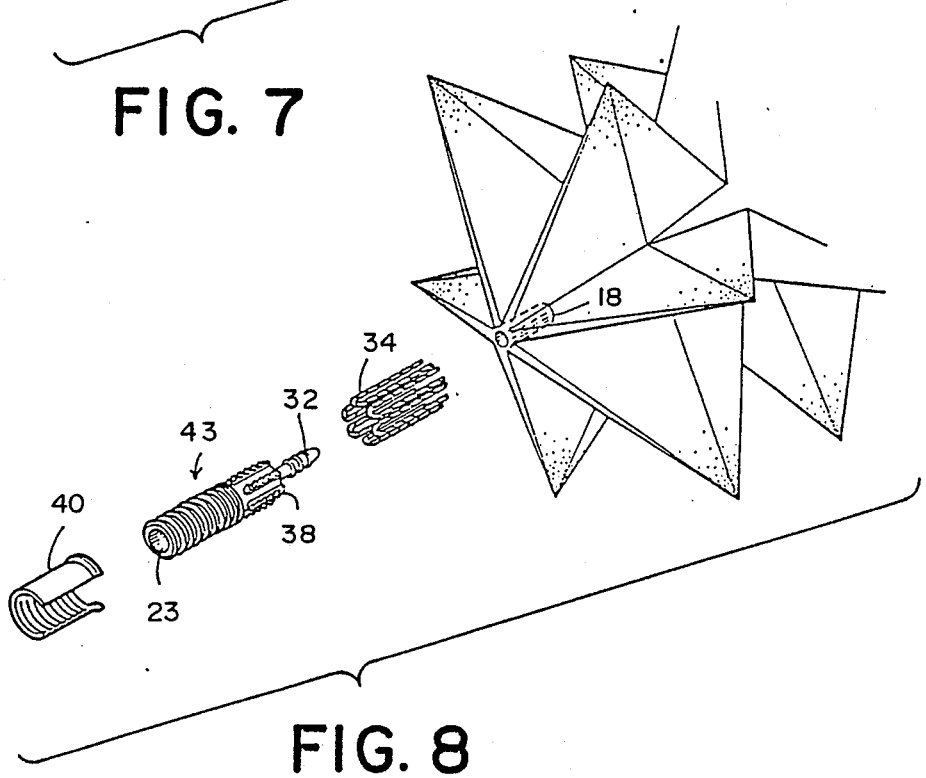
FIG. 8 is another end connector assembly similar to FIG. 7.

FIG. 8 illustrates yet another alternative end connector 43 in which the fluid orifice 23 is at the end rather than running transversely to the axis of the actuator 14.

Figure 9:
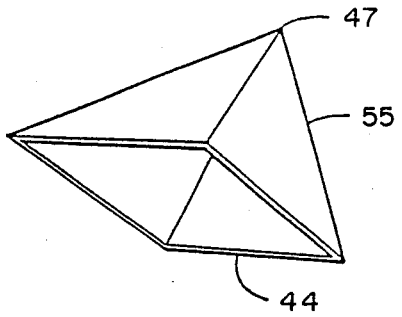
FIG. 9 is a perspective view of a four-sided pyramidal protrusion forming one of several which comprise a hollow enclosure.
Figure 10:
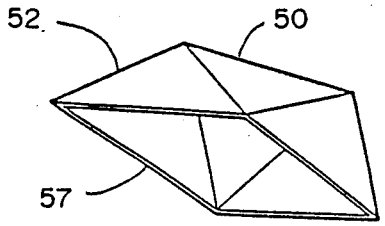
FIG. 10 is a perspective view of a truncated pyramidal polyhedron which is adapted to form one of the plurality of polyhedrons of the hollow enclosure.

Referring to FIG. 5, the protruding polyhedra of hollow enclosure 14 are four-faced pyramids joined to each other along their basal edges 44 by continuous folds or flexible seams 54. Each face 48 of a pyramid is joined to adjacent faces 48 by flexible lateral seams 55 extending along corners 46. The polyhedra could be truncated pyramids as shown in FIG. 10 meeting along a truncated edge 50 having lateral seams 52 and basal edges 57 rather than having lateral seams 55 as shown in FIG. 9 meeting at an apex 47. The polyhedra of hollow enclosure 14 need not be all identical nor need they be symmetrical.

The cable network 10 has segments or links 20 which occupy the valleys between adjacent polyhedra. They need not be attached to the hollow enclosure 15, but may optionally be attached thereto or embedded in the material of the hollow enclosure 14.

In operation, the admission through orifice 16 of fluid pressure inside hollow enclosure 14 causes the membrane of the latter to flex and accommodate an increase in volume inside enclosure 14. The expansion of enclosure 14 causes the network of linked cables 10 to expand radially and contract axially; thus, the linked cables 10 transfer tension in the membrane of the hollow enclosure 14 to pulling force on the end connectors 12 and 13.

When the actuator 11 is fully extended, each polyhedron is collapsed to its minimum possible volume which is negligible compared to its expanded volume. As actuator contraction develops, each polyhedron expands its volume by folding articulation along its lateral seams 55. In addition, the polyhedra alter their mutual orientation by folding along their common basal edges 44. The net result is an increase in both radius and total enclosure volume, and a corresponding shortening of the enclosure 14. The polyhedra are each dimensioned so that articulation is accompanied by only negligible change in their surface dimensions while also maintaining substantially shear-free connections to each other. Avoidance of elastic deformation in this manner permits the enclosure to be fabricated from impermeable substantially non-elastic impregnated fabric or even from rigid hinged plates. However, the former material is preferable inasmuch as the flexible fabric distributes tension forces over the entire surface area of the enclosure. At full expansion (actuator-contracted), the flexible fabric polyhedra tend to develop a moderately curved or conical form, and the polyhedra faces will bulge with only minimal stretching.

The folding articulation of the polyhedra facilitates contraction of the actuator 11 with only a relatively small change in radius of the portion of the hollow enclosure defined by the basal seams 54 from that in an extended condition to that in a contracted condition. The latter radius change is small compared with the inflatable balloon-like devices having a plurality of longitudinally-extending load bearing cables. The actuator 11 is capable of achieving contractions in excess of 45%. The cable network 10 constrains radial expansion of the enclosure, thereby minimizing elastic deformation as well as relieving interpolyhedra seams of any longitudinal tension. Cable network 10 transmits a large axial force to the end connectors, thereby minimizing axial stress on the enclosure fabric at the end connectors and failure of the enclosure 14.

FIG. 5 and FIGS. 15 through 18 show expanded hollow enclosures (actuator-contracted) without a network of linked cables (illustrated in FIG. 6). For small actuators or actuators operating at lower pressure, the network of linked cables is not necessary, since the tensile strength of the hollow enclosure itself is sufficient to transmit pulling forces to the ends of the actuator Therefore, FIG. 5 and FIGS. 15 through 18 represent independent actuator embodiments. End connectors for actuators without a network of linked cables are optional. If end connectors are employed, they may be similar to those depicted in FIGS. 4, 7 and 8, but without provision for terminating the cables 10, and without the retaining sleeve 30 and 40.

Figure 11:
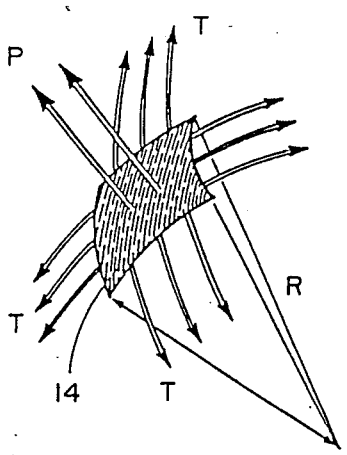
FIG. 11 is a perspective view of the forces on an element of fabric of the hollow enclosure.
Figure 12:
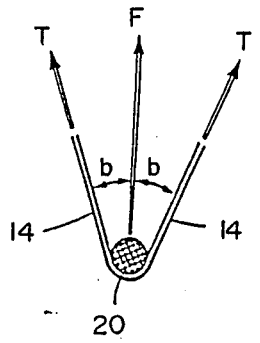
FIG. 12 is a schematic force diagram showing the fabric-cable interaction.

A theoretical analysis of the actuator 11 involves a force equilibrium analysis as well as an energy analysis. The essential concept of the force equilibrium analysis is the transformation of outward pressure forces on the polyhedra faces into longitudinal tension force in the cable mesh. Considering an isolated fabric polyhedron, the faces of the polyhedron balance outward pressure force by developing a moderate curvature and internal tension T shown in FIG. 11 according to Laplace's formula, as follows:

$$2T/R = P \quad (1)$$

where:
T=internal tension force per unit width of fabric
R=radius of curvature of the fabric
P=pressure difference between the interior and the exterior of the fabric Next, considering a cable segment 20 as shown in FIG. 12 acted on by the tension forces T of adjacent polyhedra faces having an angle *2b* between them, the resultant force per unit length F on the cable segment 20 is given by:

$$F=2T \text{ ccs } b \quad (2)$$

Thus, if the polyhedra has a very flat profile, that is, a low apex, then angle b is large and cos b is small, thereby reducing force F.

Figure 13:
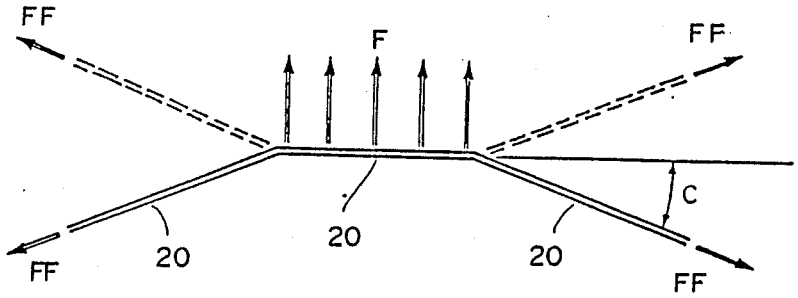
FIG. 13 is a schematic elevation view of a force diagram on a mesh segment.

Force F on the cable segment 20 perpendicular thereto is balanced by the large tension forces in the adjacent cable segments as shown in FIG. 13 according to the following:

$$FF = \frac{F\,1}{M \sin c}$$

where:
FF=adjacent cable segment tension
F=perpendicular force on the cable segment according to Equation 2
c=angle between the cable segment and its adjacent neighbouring segments
M=the numbers of connecting segments at the two ends of the segment under consideration
1=segment length The above formula ignores the small segment curvature and the three-dimensional aspect of the force equilibrium equation.

Figure 14:
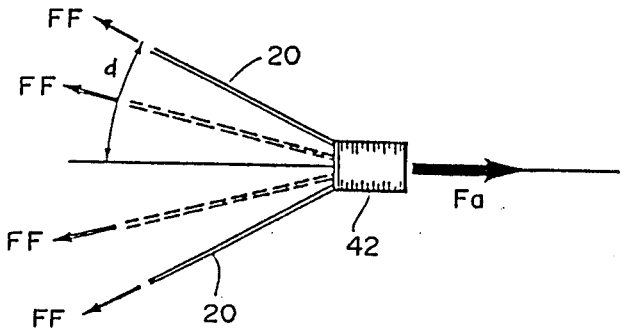
FIG. 14 is a schematic view of a force diagram showing the forces on an end connector.

Finally, considering N cable segments meeting end connector 42 at angle d as shown in FIG. 14, the resultant actuator force Fa is given by:

$$Fa=N\ FF \cos d$$

An energy analysis can equate the work done by the fluid interior to the enclosure, to the work done by the contracting actuator on its external end connections because of the minimal elastic strain energy accompanying polyhedra articulation; thus, the force on a load to the end connectors is given by the following:

$$Fa=-PdV/dL$$

where:
L=length of the enclosure
P=fluid pressure in the enclosure

In this case, a tension force is considered to be positive. For an actuator of original length Lo, Fa is proportional to the square of Lo.

With this second (energy) approach, force versus contraction, maximum contraction, etc., can be determined by computing the geometrical behaviour of the articulating enclosure as it contracts. Articulation with minimal deformation can also be ensured by testing specific polyhedra designs in this computation. Generally, very large forces are achieved at small contractions, and less forces at large contraction. By appropriate choice of numbers and forms of polyhedra, one can tailor specific aspects of actuator behaviour, such as maximum contractions, magnitude of axial force, radial size, etcetera, exhibiting a versatility which distinguishes the present actuator from other tension actuators. Specific designs can be obtained which exhibit greater than 45% maximum contraction.

An alternative configuration for the protrusions of an actuator is illustrated in FIG. 15 in which the protrusions 60 are in the form of convex polyhedra 70 having six faces 66 and a four-sided base 64 wherein the top of the polyhedra are truncated in a direction substantially parallel to the base when the polyhedra are folded flat.

Yet another alternative configuration for the actuator is illustrated in FIG. 16 in which the protrusions consist of a four-sided base 72 and an arcuate periphery 74 extending from one corner of the base to a diagonally-opposite corner thereof in a direction substantially axially of the actuator.

FIG. 17 illustrates an actuator having a plurality of convex polyhedra 76 joined along their bases with each polyhedra having a four-sided base and an upper periphery truncated transversely to the direction of the base when the polyhedra are folded flat.

Finally FIG. 18 illustrates yet another embodiment of an actuator in which the protrusions are in the form of domes 78 joined together along base edges.

Other variations, departures and modifications lying within the spirit of the invention and scope as defined by the appended claims will be obvious to those skilled in the art.

We claim:

1. An axially contractable actuator, comprising:

(a) an elongated hollow enclosure formed by a fluid impermeable and substantially non-elastic flexible material having a plurality of protrusions each with respective bases having more than three sides, each base side of a protrusion being attached to a base side of an adjacent protrusion by a flexible seam of continuous fold, and each protrusion foldable about a plane dividing the protrusion into two parts, from an axially-extended condition in which the base sides are substantially parallel to an axially-contracted condition in which the protrusion encloses a volume larger than that enclosed in the axially-extended condition, and a pair of axially-aligned end terminations, one at each end of said enclosure.

(b) a means for introducing pressurized fluid into the interior of said hollow enclosure; and (c) a means for transmitting tension force in the material of said enclosure to axial pulling force at the end terminations.

2. An actuator as in claim 1, including a network of linked cables attached to end connectors which are coupled to the said end terminations wherein the cable network is nonintegral with the enclosure and extends over the base seams of said protrusions to embrace said hollow enclosure for transmitting tension force in the enclosure to pulling force at the end connectors.

3. An actuator as in claim 2, wherein said end connectors have a plurality of longitudinally-extending spaced apart cable stanchions for receiving cable loops from ends of said linked cables which pass between said stanchions and loop around ends thereof, a nipple protruding from an end of one of said connectors for snug reception of a corresponding end termination of said hollow enclosure and a retainer ring for engagement over said stanchions so as to lock the cable loops in place around said stanchions, and hold cables next to the hollow enclosure.

4. An actuator as in claim 3, wherein one of said nipples has a hollow interior and is in fluid communication with a fluid orifice in said connector for coupling to a source of pressurized fluid.

5. An actuator as in claim 3, wherein said linked cables are each terminated with a bulbous fitting and said end connectors have corresponding sockets radially spaced apart for reception of respective fittings and a retainer ring for engagement over ends of said cables for retention thereof to said end connector.

6. An actuator as in claim 1, wherein said protrusions are each in the shape of convex four-sided pyramids.

7. An actuator as in claim 1, wherein said protrusions are in the shape of convex polyhedra.

8. An actuator as in claim 7, wherein said polyhedra are each truncated transversely to the base thereof when the associated polyhedra are folded substantially flat.

9. An actuator as in claim 7, wherein said polyhedra are each truncated substantially parallel to the base when the associated polyhedra are folded substantially flat.

10. An actuator as in claim 1, wherein the protrusions have an arcuate outer periphery extending from one end thereof to an opposite end thereof.

11. An actuator as in claim 1, wherein the protrusions are substantially dome-shaped.

12. An actuator as in claim 1, where said enclosure is constructed or rigid planar panels connected by flexible seams.

13. An actuator as in claim 1, or claim 12, where said enclosure is constructed from flat sheet material.

14. An inflatable axially contractable actuator bladder, comprising:

(a) a plurality of protrusions disposed about said bladder periphery, each such protrusion has a respective base with at least four sides, each base side of a protrusion is substantially straight and attached to a base side of an adjacent protrusion by a first flexible seam or continuous fold, each protrusion is foldable about a second flexible seam or continuous fold, said second seam or fold being in a plane dividing the protrusion into two parts, from an axially extended condition in which the protrusion encloses a reduced volume to an axially contracted condition in which the protrusion encloses a larger volume.

15. An inflatable actuator bladder axially contractable along a main axis thereof, comprising:

(a) a bladder having a plurality of protrusions about the periphery thereof, each protrusion having at least four sides and an arcuate outer periphery, each said base side of a protrusion is substantially straight and attached to a base side of an adjacent protrusion by a first flexible seam or continuous fold and each protrusion is foldable about at least one second flexible seam or continuous fold, said second seam or fold being in a plane which divides the protrusion into parts and which incorporates the main axis of the bladder, from an axially extending condition in which the base sides of the protrusion are substantially aligned thereby enclosing a reduced volume to an axially contracted condition in which the protrusion encloses a larger volume.

* * * * *